United States Patent [19]

Deutsch

[11] Patent Number: 4,887,587

[45] Date of Patent: Dec. 19, 1989

[54] COMMERCIAL AIR VENTILATION SYSTEM

[76] Inventor: Michael Deutsch, 3420 E. Shea - Ste. 125, Phoenix, Ariz. 85028

[21] Appl. No.: 214,329

[22] Filed: Jul. 1, 1988

[51] Int. Cl.[4] ..... F24C 15/20

[52] U.S. Cl. ..... 126/299 D; 55/DIG. 36

[58] Field of Search ..... 126/299 R, 299 D, 299 E, 126/300, 301, 21 R, 285 A; 98/115.1, 115.2, 115.3; 55/DIG. 36

[56] References Cited

U.S. PATENT DOCUMENTS

| | | | |
|---|---|---|---|
| 3,645,194 | 2/1972 | Ahlrich | 126/299 D |
| 4,186,727 | 2/1980 | Kaufman et al. | 126/299 D |
| 4,346,692 | 8/1982 | McCauley | 126/299 D |
| 4,586,486 | 5/1986 | Kaufman | 126/299 D |
| 4,655,194 | 4/1987 | Wooden | 98/115.1 |

*Primary Examiner*—James C. Yeung

*Attorney, Agent, or Firm*—Poms, Smith, Lande & Rose, Professional Corporation

[57] ABSTRACT

A commercial air ventilation system with an improved air distribution and mixing characteristics for use in a commercial kitchen is disclosed herein. The air ventilation system is characterized by a commercial stove top hood which is divided into make-up air and exhaust air sections. The make-up air section is divided into primary make-up air plenum and a secondary make-up air plenum. The secondary make-up air plenum allows air flow into a pre-exhaust chamber through a continuously perforated plate without the need for a screen. Air flows from the pre-exhaust chamber to an exhaust cavity, across a grease filter and out through an exhaust plenum and exhaust conduit in such a manner that the contaminated air is expelled from the kitchen. The make-up air which rushes in to replace this air does so in a moderate and controlled manner so as to avoid the temperature extremes and drafts which otherwise are often prevalent in the kitchens of commercial establishments such as restaurants and hotels.

7 Claims, 2 Drawing Sheets

III
IV
II
10
12
14
15
16
17
18
19
20
22
23
24
25
26
28
30
31
32
34
36
37
38

COMMERCIAL AIR VENTILATION SYSTEM

FIELD AND BACKGROUND OF THE INVENTION

1. Field of the Invention

This invention relates to air ventilation and purification systems and in particular to a commercial air ventilation system suitable for removing cooking fumes and other waste produced as a result of restaurant or commercial establishment cooking.

2. Background of the Invention

Large restaurants and other commercial cooking establishments employ a kitchen which may have numerous stove tops and ovens all operating simultaneously, cooking food in quantities much larger than is normally encountered in a residential kitchen. As a result of cumulative open stove cooking over a hot grill, large amounts of air may be contaminated with cooking fumes and grease that is normally produced in the cooking process. In order to comply with local municipal codes as well as assuring health, safety and cleanliness of the kitchen facilities, the heated and contaminated air must be evacuated from the kitchen and away from the stove. The Prior Art has taught that a mere exhaust hood is not sufficient to accomplish the requirements of commercial air ventilation.

In particular, U.S. Pat. Nos. 4,085,735 (issued Apr. 25, 1978) and 4,186,727 (issued Feb. 5, 1980), both to Kaufman, are directed to an air ventilation and washing system suitable for use in a commercial establishment and are typical of the conventional commercial exhaust and ventilation art. These references note that if the only focus of cooking were the exhaust, the strength of the exhaust fans needed to clean the air within a commercial kitchen would subject the kitchen facilities to enormous drafts resulting in difficulties as well as intolerable working conditions during the extremes of summer and winter. Such a large "exhaust-only" system does not allow the restaurant or commercial establishment to maintain a reasonable temperature in its kitchen for proper working conditions. In order to remove the grease laden and contaminated air derived from the cooking process in the commercial kitchen from the premises, it is necessary to provide an input of "make-up air" to replace the air being exhausted from a commercial cooking establishment.

In particular, the Kaufman '727 patent is directed to an air ventilation and washing system which provides a commercial hood where make-up air is directed vertically downward into an exhaust chamber which leads directly up an output duct for exhausting contaminated air off the premises. The conventional air ventilation system, represented by the Kaufman '727 patent, is a system which provides ambient make-up air supplied to a make-up air plenum, which is then distributed to the exhaust cavity.

After mixing with room air and contaminated air above the cooking surface, the ambient make-up air from the exterior does not contact the personnel working below the hood or the food or cooking services below the hood. In addition, Kaufman attempts to exhaust the contaminated air while avoiding turbulence and escape of contaminated air from the exhaust collector cavity.

Although such an air ventilation system, as disclosed in Kaufman '727, moves in the direction of proper make-up air distribution for replacing contaminated air, the Kaufman system relies on the creation of a vortex by a vortex baffle provided in the hood between the make-up air cavity and the exhaust cavity to cause the mixing of room air and make-up air from the exterior. The make-up air is first directed vertically downward; and, then the make-up air is expected to sharply turn twice, in a U-turn fashion, whereby air is directed immediately upward and out an exhaust duct.

The Kaufman hood design is directed to a system which allows little mixing of the make-up air with the air immediately above the surface of the stove, but rather causes the make-up air to mix with the contaminated air at a height sufficiently above the stove surface so that make-up air does not contact kitchen personnel.

While the Kaufman '727 patent discloses ambitious goals for achieving proper air ventilation in a commercial kitchen, providing vertically spaced perforated plates and intermediate vertical baffles which cause the air to travel in a tortuous path along the length of the make-air plenums needlessly complicates the ventilation system. In fact, in one environmental plan, FIG. 14 of Kaufman, the make-air from the plenum (after tortuously passing through a make-up air diffuser) is required to pass through a constricted screen 283(*a*) which is one-third the width of the body along sidewall 291, before the air enters the exhaust chamber. Also the Prior Art as represented by Kaufman places great reliance on the vortex established by baffle 67 where the make-up air 164 mixes with contaminated air 161 (FIG. 4). The Kaufman '727 patent has a combination plate and screen fabric which comprise the air diffusion means. This is an elaborate element and requires precision manufacture and costs. A clamping means is needed to hold these elements of the diffusion means together. Thus, the state of the art heretofore envisions a complex mechanism for air diffusion and vortex creation.

SUMMARY OF THE INVENTION

What is needed is a commercial air ventilation system which includes an elongated ventilating hood and has both an intake opening and an external conduit. The ventilating hood, in the applicant's design, defines more than one chamber for providing make-up air to the system. After the make-up air passes through at least a primary and secondary make-up air plenum, this make-up air is presented to a continuously perforated plate (not a screen) for entry into a pre-exhaust chamber.

As air flows from the pre-exhaust chamber to the exhaust chamber, a special vortex piece, which hangs vertically between the pre-exhaust and exhaust cavity, has an end piece that is slanted 30° off-vertical, thereby allowing the make-up air to more evenly mix. The air passes into the exhaust cavity for removal of contaminated air which also enters this cavity. The combined make-up and exhaust cavity air then passes through a grease filter and into an exhaust plenum for exhaust through the exhaust conduit, out of the kitchen premises.

The applicant's invention envisions a ventilation. hood where the same wall, which divides the pre-exhaust chamber from the exhaust cavity, also divides the primary and secondary make-up plenum. In addition, a second divider wall oriented 45° off-vertical, divides the primary make-up plenum from the exhaust cavity.

The primary and secondary make-up plenums are separated by a continuous linear double slot wall. Make-up air passes from the secondary make-up air plenum into the pre-exhaust chamber through a perforated plate which does not itself require an additional screen. The plate replaces the complex air diffusion devices taught in the prior art.

The exhaust cavity situated between the pre-exhaust chamber and the exhaust plenum is defined in its upper surface by a triangular-shaped roof formed by the grease filter between the exhaust cavity and the exhaust plenum and the second divider wall which divides the exhaust cavity from the primary make-up plenum.

The applicant's design achieves a commercial air ventilation system with improved air distribution and mixing characteristics through use of primary and secondary make-up air plenums that are divided by a continuous linear double slotted wall having perforated plates. By not allowing make-up air to directly rush and flow into the preexhaust chamber, the applicant's design allows a more uniform air distribution to occur in a commercial kitchen setting. This and other advantages and objectives as disclosed by applicant's invention will become apparent as set forth in the description of the drawings and detailed description of the preferred embodiment which follows.

DETAILED DESCRIPTION OF THE PREFERRED EMBODIMENT

Figures 1, 2:
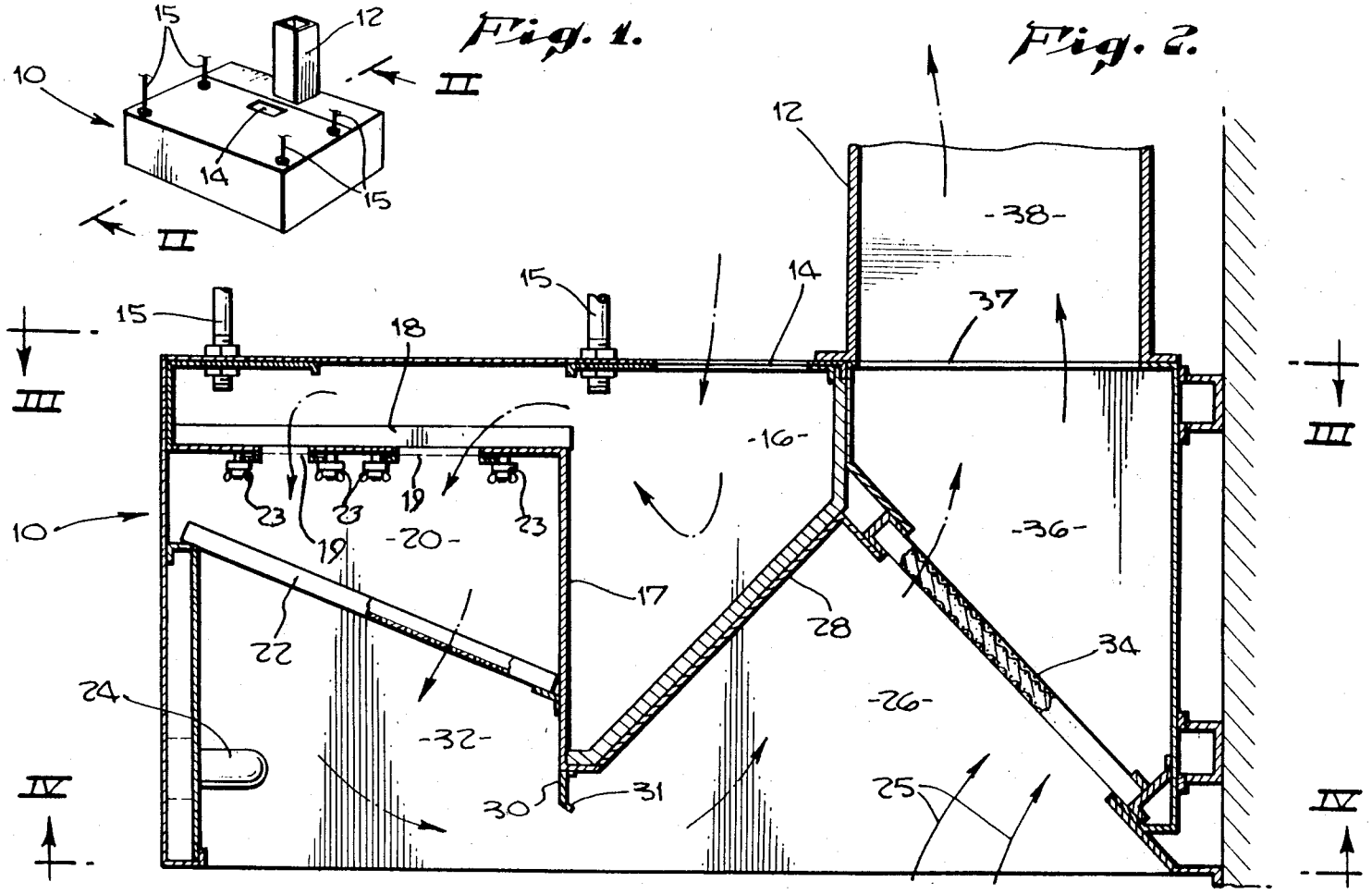
FIG. 1 is a perspective view of the commercial air ventilation system of this invention showing the commercial air ventilation hood which hangs over a commercial cooking stove.
FIG. 2 is a cross-sectional view taken along line II—II of FIG. 1.

With reference to FIGS. 1 and 2, the commercial air ventilation system of this invention is shown. An air ventilation hood 10 is supported by rods 15 (acting as tension supports suspended from the ceiling of the commercial establishment) to provide additional support for the hood. The hood 10 forms a canopy which generally fully encloses the air space immediately above the stove top of a commercial kitchen. The hood 10 may be a generally rectangularly-shaped canopy. The hood 10 normally has an intake opening 14 for receiving make-up air and an exhaust conduit 12 for allowing the escape of contaminated air once the cooking fumes have been processed under the hood 10.

Figure 3:
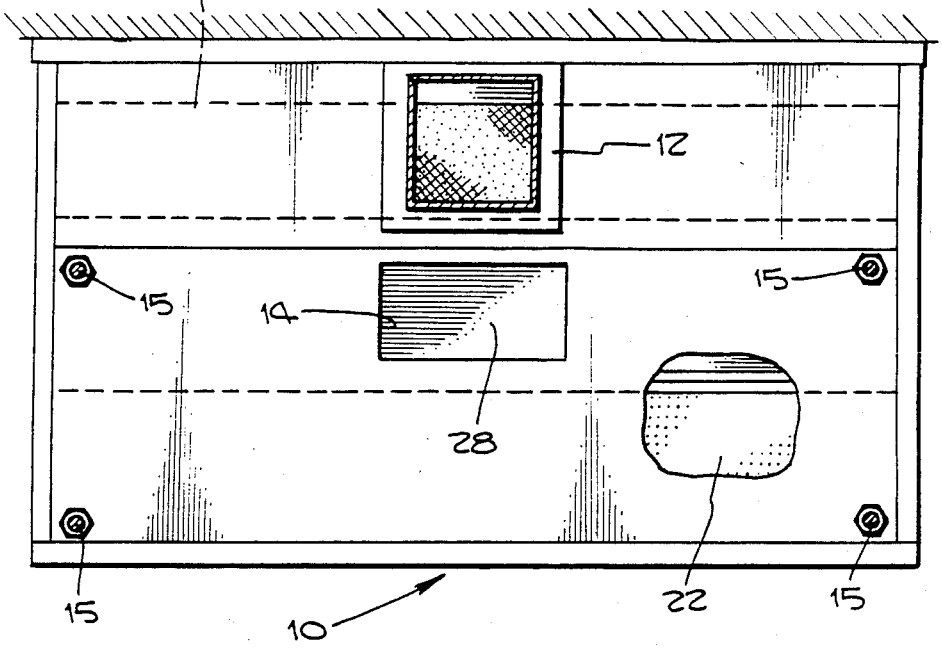
FIG. 3 is a top-plan view of the hood taken along line III—III of FIG. 2.

With particular reference to FIGS. 2 and 3, makeup air is drawn into the make-up air opening 14 and enters the primary make-up air plenum 16. It is contemplated that an intake duct (not shown) be positioned adjacent the intake opening 14. Rather than travel directly vertically into the pre-exhaust chamber 32, make-up air is distributed within the primary makeup air plenum 16 before flowing over to the continuous linear double slotted wall 18. Continuous linear double slotted wall 18 includes a plurality of slots with perforated plates 19 which are attachable to wall 18 by screws 23. The continuous linear double slotted wall 18 acts to break up make-up air (derived from the primary make-up plenum 16), so that the make-up air is uniformly and downward vertically distributed to the secondary make-up air plenum 20.

The function of the secondary make-up air plenum is to draw make-up air from the primary make-up air plenum 16 so that the make-up air may then be directed against a continuous perforated plate 22 which is suitably perforated and allows air passage into the pre-exhaust chamber 32.

The applicant's invention, unlike prior art designs, uses primary 16 and secondary 20 make-up air plenums which are adjacent to one another, but not vertically directed with respect to one another. The use of a perforated plate 22 does not require additional screening (as is taught in the prior art) because the make-up air has been processed through the primary makeup air plenum 16 and the secondary make-up air plenum 20 before reaching the perforated plate 22 and before entering the pre-exhaust chamber 32.

As air enters the pre-exhaust chamber 32, it passes by the vapor-proof light 24 as the make-up air is brought from the pre-exhaust chamber 32 into the exhaust cavity 26 to mix with contaminated air. The contaminated air is derived from the lower open portion of the hood 10 as shown at arrows 25.

As the make-up air flows from the pre-exhaust chamber 32 into the exhaust cavity 26, it encounters a special vortex piece 30. The special vortex piece 30 hangs vertically downward from the wall 17. Wall 17 divides the primary make-up air plenum 16 from the secondary make-up air plenum 20. The vortex piece 30 has an attached end piece 31 which is purposely oriented 30° off the vertical in order to gently give rise to turbulence in the exhaust cavity 26; thereby, allowing the contaminated air 25 to be drawn into the exhaust cavity 26 and mixed with make-up air as it passes around the end piece 31 of the vortex piece 30.

Before passing from the exhaust cavity 26 to the exhaust plenum 36, the air is caused to pass through a standard grease filter 34. After entering the exhaust plenum 36, the combined make-up and contaminated air passes from the exhaust plenum 36 to an exhaust conduit opening 37 and out through the exhaust 38 of the exhaust conduit 12. In this manner, the commercial air ventilation system of applicant's design provides a generally cleaned and refreshed commercial cooking environment.

Figure 4:
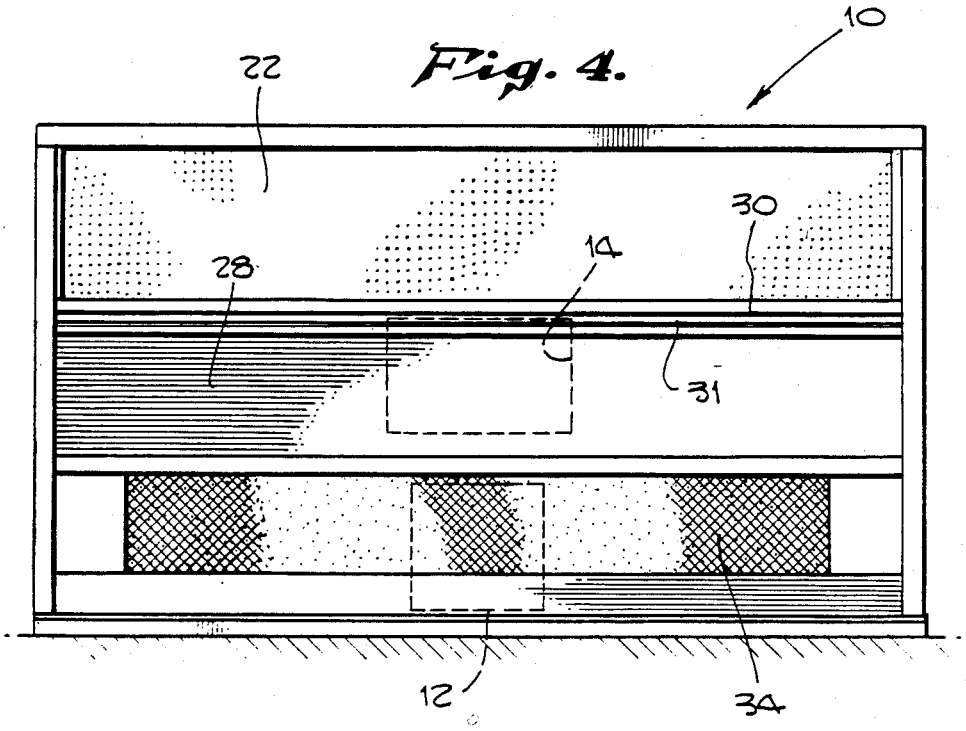
FIG. 4 is a bottom-plan view looking upward into the commercial hood shown in FIG. 2 and taken along line IV—IV of FIG. 2.

FIGS. 3 and 4 reveal the continuous perforated plate 22 (FIGS. 3 and 4) as well as the grease filter 34 (FIG. 4). It can be seen by examining FIG. 4, that make-up air which enters and crosses the continuously perforated plate 22 does not have a considerable distance to travel before it reaches the standard grease filter 34. In this manner, cross-ventilation, with a replacement of exhausted air by make-up air, is smoothly and efficiently accomplished.

While applicant has presented a preferred embodiment of the commercial air ventilation system for use in a commercial kitchen, it is clear that additional modifications may be made to achieve the desirable results that the applicant's design achieves. For example, the vortex piece 30 may be shifted slightly over to enlarge the pre-exhaust chamber 32 so that the vortex piece 30 would hang directly from the wall partition 28 rather than wall 17 as shown in FIG. 2. This and other modifications are deemed to be within the structure taught by the applicant or its equivalence. The appended claims are to be construed as covering the invention as disclosed herein and reasonable equivalence thereof.

What is claimed is:

1. A commercial air ventilation system, comprising:

an elongated ventilating hood;

defining plural means for providing make-up air to said system, said plural means for providing make-up air to said system includes a primary make-up air plenum and a secondary make-up air plenum, said primary and secondary make-up air plenums separated by a continuous linear double slot wall having perforated plates;

an intake opening;

an exhaust conduit opening;

means for exhausting air; and a continuous air diffusing means separating said plural means for providing make-up from said means for exhausting air, said continuous air diffusing means sloped for diffusing air into said means for exhausting air.

2. The commercial air ventilation system of claim 1 wherein said means for exhausting air includes a pre-exhaust chamber, an exhaust cavity, a vortex piece juxtaposed between said preexhaust chamber and said exhaust cavity and an exhaust plenum leading to said exhaust conduit opening.

3. The commercial air ventilation system of claim 2, wherein said vortex piece extends downward and forms a 30° off-vertical angle in order to induce a vortex in said exhaust cavity.

4. The commercial air ventilation system of claim 3 wherein a divider wall separates said primary make-up air plenum from said exhaust cavity, wherein said divider wall is oriented 45° off vertical.

5. The commercial air ventilation system of claim wherein said air diffusing means is a continuous perforated plate.

6. In a commercial air ventilation system for providing clean make-up air to a commercial cooking environment while exhausting waste fumes and cooking odors, the improved air ventilation system comprising:

a hood having a make-up air section and an exhaust section;

the make-up section of said hood operatively associated with an intake opening and an intake duct;

the exhaust section of said hood operatively associated with an exhaust conduit;

said make-up air section comprising:

a primary make-up air plenum and a secondary make-up air plenum;

the primary and secondary make-up air plenums separated by a continuous linear double slot wall; and, a continuous perforated plate separating said make-up air section from said exhaust section of said hood;

said exhaust section comprising;

a pre-exhaust chamber;

an exhaust cavity;

an exhaust plenum; and, an exhaust conduit opening;

a means for forming a vortex juxtaposed between said pre-exhaust chamber and said exhaust cavity;

a grease filter separating said exhaust cavity from said exhaust plenum;

said exhaust cavity having a triangular-shaped roof formed by said grease filter and partition between said cavity and said primary make-up air is introduced into said hood and exhaust air drawn from said hood in a rapid and controlled manner.

7. The commercial air ventilation system of claim 6, wherein said means for forming a vortex is a vertically extending vortex piece, extending vertically downward between said pre-exhaust chamber and said exhaust cavity, the vortex piece having an unsecured end which is folded 30° off from a vertical direction.

* * * * *